United States Patent [19]

Dvorachek et al.

[11] 4,407,553

[45] Oct. 4, 1983

[54] ELECTRICAL CONNECTOR HAVING THREADED CONNECTION BETWEEN RECEPTACLE PARTS

[75] Inventors: Harold A. Dvorachek, Iola, Kans.; Boleslaw M. Klimek, Des Plaines, Ill.

[73] Assignee: Echlin Inc., Branford, Conn.

[21] Appl. No.: 391,230

[22] Filed: Jun. 23, 1982

Related U.S. Application Data

[63] Continuation of Ser. No. 149,123, May 12, 1980, abandoned.

[51] Int. Cl.[3] ..... H01R 13/34

[52] U.S. Cl. ..... 339/14 P; 339/139 R; 339/199 C

[58] Field of Search ..... 339/14 R, 14 P, 139, 339/196, 199, 209

[56] References Cited

U.S. PATENT DOCUMENTS

| | | | |
|---|---|---|---|
| 1,750,014 | 3/1930 | Lofgren | 339/14 R |
| 2,410,618 | 11/1946 | Zelov | 339/14 R |
| 3,046,515 | 7/1962 | Appleton | 339/14 R |
| 3,368,184 | 2/1968 | Braun | 339/199 R |
| 3,384,862 | 5/1968 | Shroyer | 339/199 C |

FOREIGN PATENT DOCUMENTS

| | | | |
|---|---|---|---|
| 492246 | 9/1938 | United Kingdom | 339/139 R |

*Primary Examiner*—Joseph H. McGlynn

*Attorney, Agent, or Firm*—Neuman, Williams, Anderson & Olson

[57] ABSTRACT

An electrical connector is disclosed which includes a receptacle in which a special threaded connection is provided between a body member of insulating material and a hollow housing member. The body member is formed from two molded parts in a manner such that a thread is provided when the two parts are secured together. A locking member is provided which also serves to provide a reliable grounding of a grounding contact.

8 Claims, 13 Drawing Figures

47
46
51
52
37
50
40
53
44
15
57
54
58
6
6
35
45
29
27
43
11

40
38
35
36
33
27
30
32
39
41
34
53

66
44
73
85
74

65
68
69
43

70
77
75
79
86
80
76

84
74
83
73

ELECTRICAL CONNECTOR HAVING THREADED CONNECTION BETWEEN RECEPTACLE PARTS

This application is a continuation of our copending application Ser. No. 149,123, field May 12, 1980, now abandoned.

This invention relates to an electrical connector and more particularly to an electrical connector in which housing and body parts are readilly assembled to be securely held together with a sealed connection therebetween. The connector is relatively simple in construction, is economically manufacturable and provides secure support of contacts and reliable grounding of a grounding contact.

BACKGROUND OF THE INVENTION

Electrical connectors are known in the art in which either a plug or a receptacle member of insulating material is mounted within a housing member which may be of metal and which protects the body member mounted therewithin. In one type of connector, for example, a metal housing member is adapted to be mounted on a metal wall and has open forward and rearward ends, with a body member of insulating material being inserted into the rearward end of the housing member and carrying contacts which are connected to a cable. Another body member may be inserted into the forward end of the housing member to engage contacts carried thereby with the contacts of the fixed body member.

In the assembly of the fixed body member within the housing, various connecting arrangements have been used including, for example, bayonet type arrangements in which the body member is placed at a certain angular position, pushed in and then turned a certain number of degrees. Such arrangements have been generally satisfactory but there have been problems which have not been recognized and dealt with by the designers of such connectors. One problem is that the connectors are not easily assembled and another problem is that the body member may become loosened, especially after periods of use in which there are repeated jars and vibrations. Also, the connectors are not as readily and economically manufacturable as would be desirable.

Another problem which has not been recognized and dealt with relates to the grounding of grounding contacts which has not always been as reliable as would be desirable, it being noted that secure grounding is very important for safety reasons. In this connection, the connector of this invention is particularly designed for and advantageous in use for providing connections between trailer and tractor portions of highway vehicles.

SUMMARY OF THE INVENTION

This invention was evolved with the general object of overcoming disadvantages of prior connectors and of providing an improved connector in which parts are readily assembled and securely held together.

Another object of the invention is to provide a connector in which the support of contacts and the grounding of a grounding contact are effected in a secure and highly reliable manner.

A further object of the invention is to provide an electrical connector which is relatively simple in construction and readily and economically manufactured.

In accordance with this invention, an electrical connector is provided in which a body member of insulating material is insertable within a hollow housing member to provide facing internal and external cylindrical surfaces, one of which is formed with a helical projection having a length of approximately 360 degrees and the other of which is formed with a helical groove also having a length of approximately 360 degrees. When the body member is inserted into an open rearward end of the housing member and rotated, the full length of the projection is disposed within the full length of the groove to properly position the body member within the housing member. This simple arrangement facilitates assembly and also provides a connection such that forces which might tend to separate the members are distributed throughout the full 360 degrees of interengaging groove and projection surfaces. It is further advantageous in that a seal is provided which inhibits passage of fluids or particulate materials through the junction between the two members.

In accordance with a specific feature of the invention, one of the members, preferably the body member, is formed by forward and rearward parts and the forward part has a surface which defines a rearwardly facing side surface of the helical groove while the rearward part has a surface which defines a forwardly facing side surface of the groove. An important advantage of this arrangement is that each of the two parts of the one member can be readily formed in a "straight-shot" molding operation and the same is true with respect to the other member which carries the projection since the projection extends through only 360 degrees.

The provision of the groove in a two-part body member has an additional advantage in that the two parts of the body member may define cavities for receiving contacts in a manner such that when the two parts are secured together, the contacts are locked in position. It is noted that with the two-part construction, the required cavities can be readily formed with a "straight-shot" molding operation, the same as is true with respect to the groove.

In accordance with another specific feature, the body and housing members are locked together by a fastener which extends through aligned radial openings, preferably located at the ends of the groove and projection, the locking member being also operative to enhance the seal between the two members.

In accordance with another feature, the locking member additionally functions in connection with providing an electrical ground and extends through a metal housing member and through a grounding contact mounted in the body member and connected to a ground conductor of a cable.

Additional features of the invention relate to details of construction of the body parts and their relationship to each other and to the contacts, providing an arrangement which can be readily, quickly and accurately assembled while securely supporting the contacts. The arrangement also is advantageous in that the conductors of connecting wires can be readily and securely connected to the contacts.

This invention contemplates other objects, features and advantages which will become more fully apparent from the following detailed description taken in conjunction with the accompanying drawings.

DESCRIPTION OF PREFERRED EMBODIMENTS

Figures 1, 2, 3, 4:
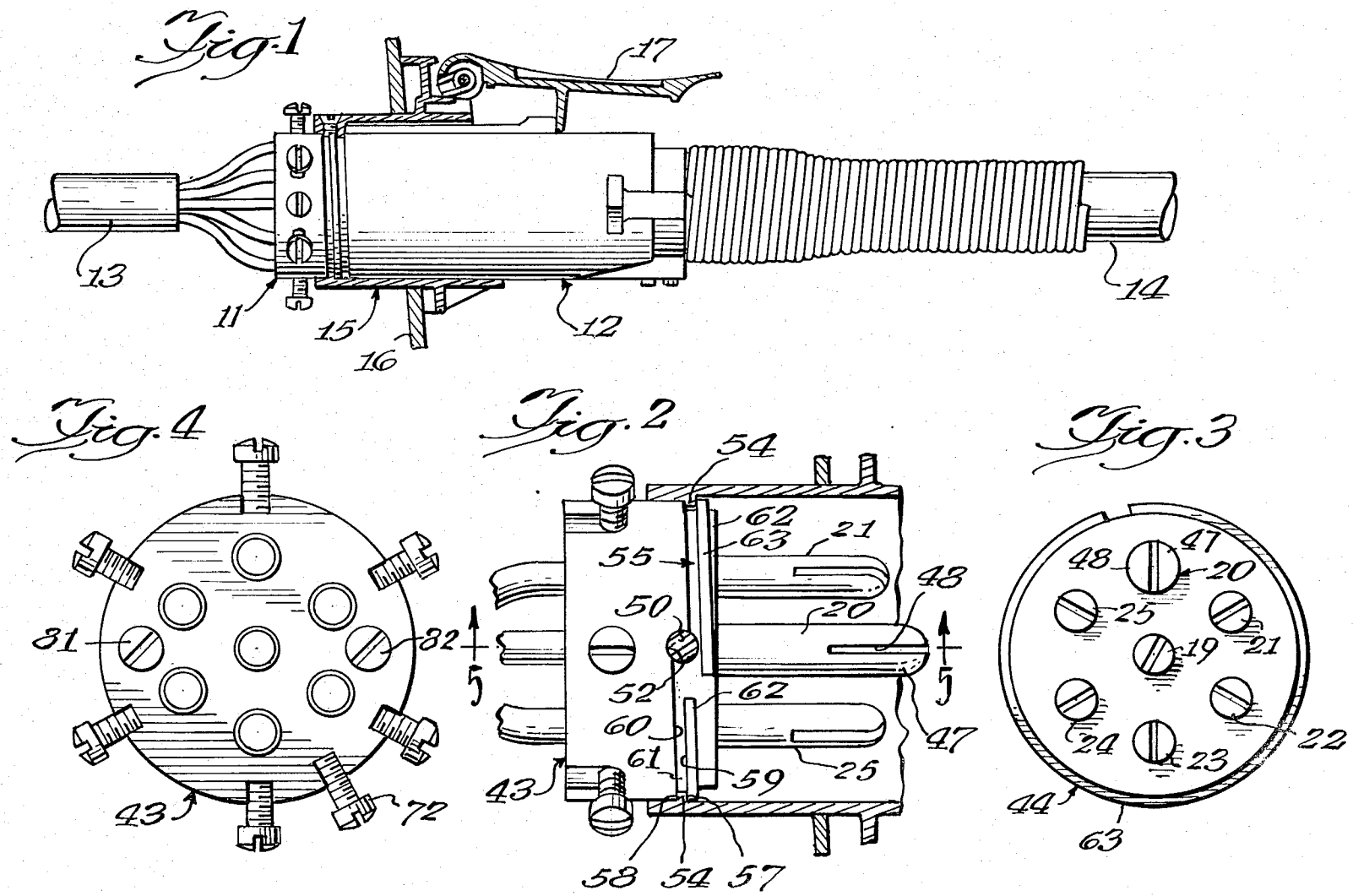
FIG. 1 is a side elevational view, partly in section, illustrating a connector assembly constructed in accordance with the invention.
FIG. 2 is a top plan view showing an insulating body of a receptacle portion of the assembly of FIG. 1, contacts carried thereby and wires connected thereto with portions of a housing of the receptacle portion being shown in section.
FIG. 3 is a forward end elevational view of the receptacle body of the connector and male contacts carried thereby as it appears when removed from the housing.
FIG. 4 is a rearward end elevational view of the receptacle body as it appears when removed from the housing.

Reference numeral 10 generally designates a connector assembly constructed in accordance with the principles of the invention. The connector assembly 10 may be used, for example, in making connections between electrical components in tractor-trailer combinations, it being understood that the invention is not limited to any particular type of use.

The assembly 10 includes a receptacle body 11 which carries male contacts engageable with female contacts which are carried by a plug 12, the contacts being connected to conductors of wires in cables 13 and 14. The receptacle body 11 is mounted in a housing 15 which is preferably of metal and which may be mounted on a metal wall 16, a hinged cover 17 being provided which is spring-urged to close the forward end of the housing 16 when the plug 12 is withdrawn therefrom.

FIG. 2 is a top plan view of the receptacle body 11, showing male contacts carried thereby and wires connected thereto with portions of the housing 15 being shown in section.

FIGS. 3 and 4 are front and rear elevational views of the receptacle body 11 as it appears when removed from the housing 15. FIG. 3 shows the male contacts protruding therefrom which include a center contact 19, a grounding contact 20 spaced radially outwardly from the center contact 19 and five additional contacts 21–25 also spaced outwardly from the center contact 19 preferably with 60° spacings between adjacent ones of the outer contacts 20–25.

Figure 5:
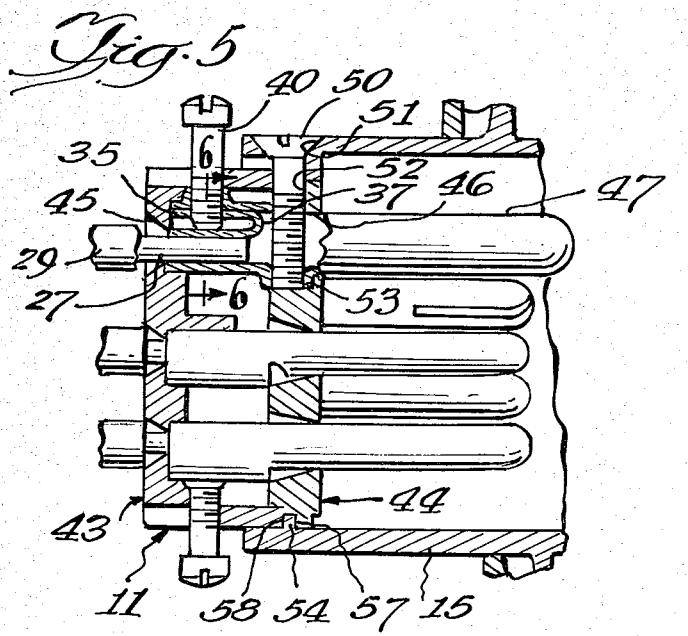
FIG. 5 is a sectional view taken substantially long line V—V of FIG. 2.

As shown in FIG. 5, the grounding contact 20 has a rearward portion which is mounted within the receptacle body 11 and which is connected to a terminal end portion 27 of a conductor of a wire 28 which includes an outer insulating portion 29, the wire 28 being one of seven wires extending from the cable 13.

Figure 6:
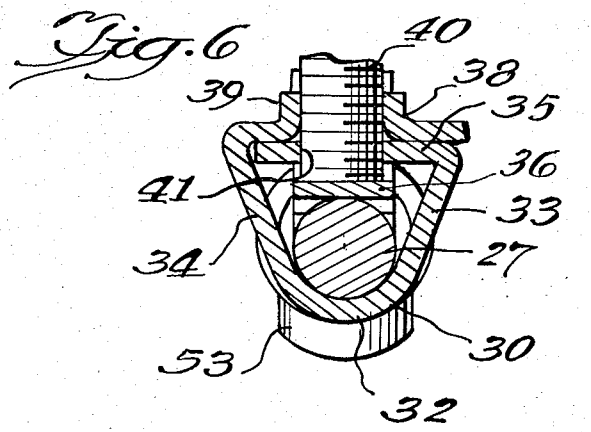
FIG. 6 is a sectional view, on an enlarged scale, taken substantially along line VI—VI of FIG. 5 and showing the construction of a rear part of one of the contacts.

As illustrated in FIG. 6, the grounding contact 20 includes a trough portion 30 which is defined by a bottom wall 32 and side walls 33 and 34. A portion 35 extends inwardly from the upper end of the side wall portion 33 and a pressure strip 36 is disposed under the portion 35 and is connected at one end thereto through a 180 degree bend 37. In addition, a section 38 is provided which extends inwardly from the upper end of the side wall portion 34 over the support section 35, the section 38 having a collar portion 39. A screw 40 has a shank portion which is threaded through the collar 39 and which extends through an opening 41 in the section 35 to engage the pressure strip 36 and press the pressure strip 36 into tight frictional engagement with the end portion of the conductor 27.

The body 11 is a two-part member which includes a rearward part 43 and a forward part 44, both of an insulating material, preferably plastic. The rearward part 43 has an opening 45 through which the conductor 27 and a portion of the wire insulation 29 may extend, and the forward part 44 has an opening 46 through which the forward end 47 of the contact 20 extends, it being noted that the contact 20 is preferably made from a one-piece blank of sheet metal, the forward end 47 being preferably formed with a rounded end but with a slot 48 which increases the resiliency of the contact and facilitates its insertion into a similar contact.

In accordance with a specific feature of the invention, the grounding contact 20 is connected electrically to the housing 15 through a screw 50 having a shank portion which extends through an opening 51 in the wall of the housing 15 and which extends through an opening 52 which is formed at the junction between the rearward and forward body parts 43 and 44. The terminal end of the shank portion of screw 50 extends through an opening in the upper wall of contact 20 and into a collar portion 53 formed in a lower wall of contact 20, the collar portion 53 being engaged with an inner surface of the forward body part 44 to limit forward movement of the contact 20. The screw 50 provides a solid electrical connection between the housing 15 and the grounding contact 20 and it also serves to lock the body 11 against rotation relative to the housing 15, cooperating with thread means as hereinafter described to provide solid and reliable mechanical support and a sealed connection between the body 11 and the housing 15.

The construction of each of the other outer contacts 21–25 and of the center contact 19 is preferably like that of the grounding contact 20 except that such contacts may be somewhat smaller in diameter as illustrated and the collar portion 53 is not required.

In accordance with an important feature of the invention, thread means are provided on external and internal generally cylindrical surfaces of the body 11 and housing 15 which surfaces are in facing relationship when the body 11 is inserted into the open rearward end of the housing 15. Such thread means preferably include a helical projection 54 on the inner cylindrical surface of the housing 15 which engages in a helical groove 55 on the outer surface of the body 11. Preferably, the projection 54 and groove 55 both have a length of approximately 360 degrees. The projection 54 has forwardly and rearwardly facing surfaces 57 and 58 and the groove 55 is defined by rearwardly and forwardly facing side surfaces 59 and 60 and a bottom surface 61. To facilitate construction of the parts by molding, the rearwardly facing surface 59 of the groove 55 is formed on the forward body part 44 while the forwardly facing surface 60 is formed on the rearward body part 43. Preferably, the projection and groove are of generally rectangular shape, as illustrated, the surfaces 57-60 extending in a radial direction for interengagement to obtain good sealing action.

To provide a lead-in for proper threading action, the forward member 44 is preferably formed with a helically extending surface 62 which is spaced from the surface 59 and which defines therewith a helical projection 63.

Figure 8:
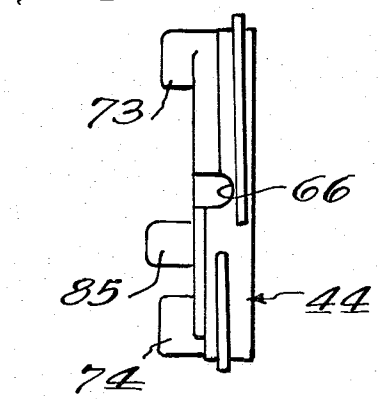
FIG. 8 is a top plan view of a forward part of the receptacle body of the assembly.
Figure 7:
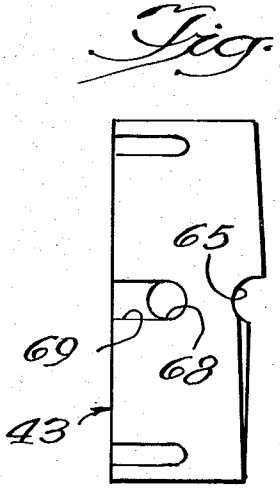
FIG. 7 is a top plan view of a rear part of the receptacle body of the assembly.
Figure 9:
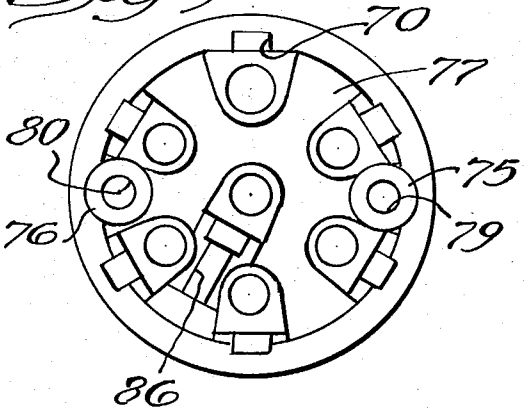
FIG. 9 is a front elevational view of the rear part of the receptacle body shown in FIG. 7.
Figure 10:
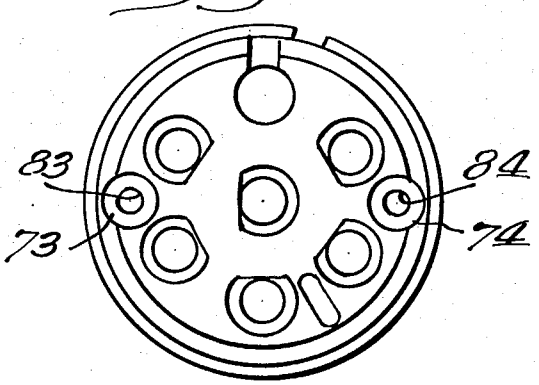
FIG. 10 is a rear elevational view of the front part of the receptacle body shown in FIG. 8.

With reference to FIGS. 2, 7 and 8, it is noted that the opening 52 which receives the grounding and locking screw 50 is defined by facing surfaces 65 and 66 of the rearward and forward parts 43 and 44. The opening 52 is located adjacent the ends of the projection 54 and the groove 55 and when the screw 50 is inserted, it further facilitates obtaining a sealed connection between the body part 11 and the housing 15.

FIGS. 7-10 illustrate the construction of the rearward and forward body parts 43 and 44 in more detail. The rearward body part 43 has an opening 68 for permitting access to the set screw 40 for the grounding contact 20, the opening 68 being at the forward end of a groove 69 extending forwardly from the rear face of the body part 43 and being at the rearward end of a groove 70 which is disposed on the inside and which extends rearwardly from the forward face of the rearward body part 43. The formation of the opening 68 in this manner facilitates molding of the part in a straight-shot molding operation. Openings for access to the screws of the other contacts 19 and 21-25 are provided in a similar manner. It is noted that the opening for the screw of the center contact is mid-way between openings for a pair of the outer contacts, a screw 72 for the center contact being of increased length.

The forward body part 44 has a pair of rearwardly projecting portions 73 and 74 which are diametrically opposite each other and which have rearward ends engaging the forward ends of a pair of pads 75 and 76 extending forwardly from a rearward wall 77 of the rearward body part 43. The pads 75 and 76 and wall 77 are formed with openings 79 and 80 through which the shank portions of a pair of connecting screws 81 and 82 extend, such shank portions being threaded into openings 83 and 84 in the projections 73 and 74.

To provide a guide for the shank portion of the screw 72 for the center contact, the forward part 44 is formed with a projection 85 which has a rearward terminal end cooperating with a recess 86 formed in a projecting portion on the rearward wall 77 of the rearward body part 43 to define a channel guiding the shank portion of the screw 72.

It will be noted that the construction of both the forward and rearward body parts 43 and 44 is such that they can be formed in straight-shot molding operations and it is also noted that the same is true with respect to the housing 15 since the projection 54 has a length of slightly less than 360 degrees. At the same time, the parts are securely fastened together with a seal being provided which inhibits flow of fluids or particulate materials through the junction between the body 11 and the housing 15. Also, the parts can be very quickly assembled since it is not necessary that the body 11 be initially located at any particular angular position. It can simply be inserted into the housing 15 and rotated until the openings 51 and 52 are in alignment. Then the screw 50 may be tightened to lock the members together as well as to provide a solid electrical ground between the housing 15 and the grounding contact 20.

Figure 12:
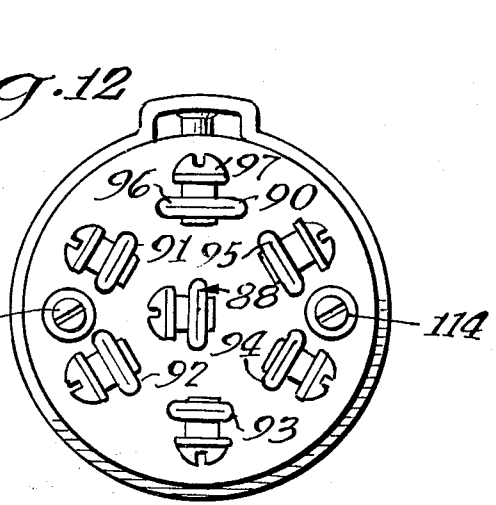
FIG. 12 is a rearward end elevational view of the modified receptacle portion of FIG. 11 but with screws and connecting wires removed.
Figure 13:
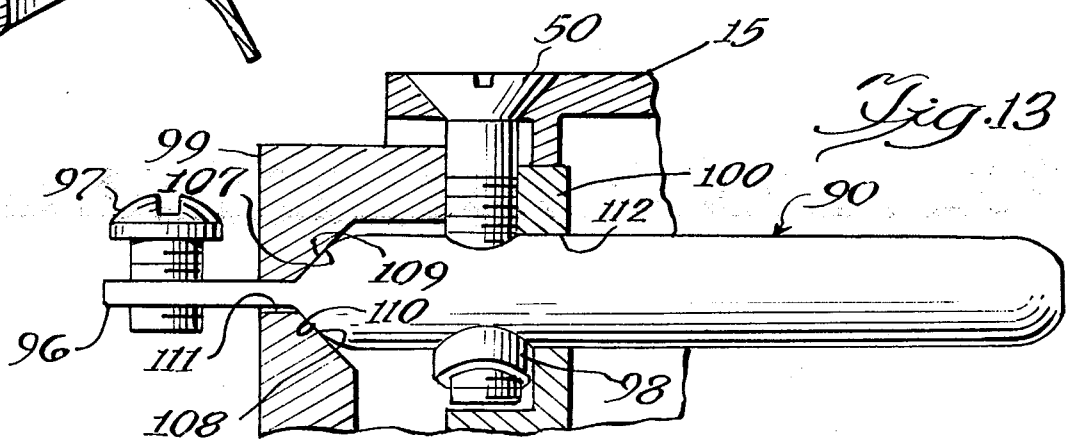
FIG. 13 is a view on an enlarged scale, partly in section, illustrating a grounding contact of the modified receptacle portion of FIG. 11 and the support thereof.
Figure 11:
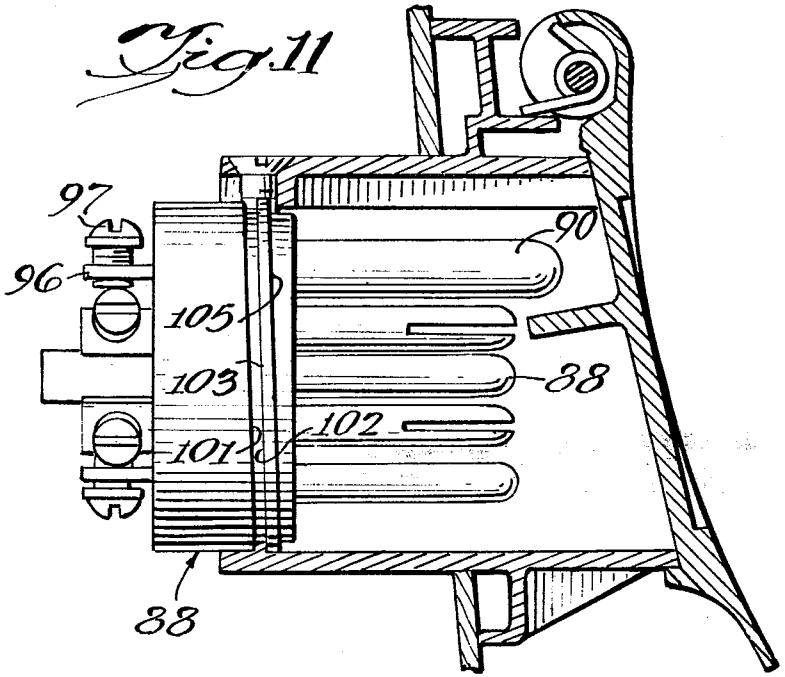
FIG. 11 is a view partly in section showing a modified receptacle portion of a connector assembly.

FIGS. 11, 12 and 13 illustrate a modified receptacle body 88 which carries modified contacts including a modified center contact 89, a modified grounding contact 90 and additional modified outer contacts 91-95.

The modified grounding contact 90 includes a forward end portion which may preferably have a construction substantially the same as that of the grounding contact 20 and which may include a rounded end and a suitable slot for increasing its resiliency. The contact 90 has a rearward end portion 96 which is flattened as shown and projects rearwardly from the receptacle body 88 to receive the threaded shank portion of a screw 97. The conductor portion of a connecting wire may be connected to the rearward end portion 96 by means of the screw 97.

The grounding contact 90 has an opening in its upper wall and a registering collar portion 98 projecting downwardly from its lower wall, for receiving the shank portion of the screw 50.

The receptacle body 88 is similar to the receptacle body 11 and includes rearward and forward parts 99 and 100 which have surfaces 101 and 102 defining side surfaces of a helical groove 103 which receives the helical projection 54 of the housing 15. The rearward part 99 has a surface 104 defining the bottom of the groove 103 and the forward part 100 has a surface 105 spaced from the surface 102 and cooperating therewith to define a helical projection.

The body 88 is thus quite similar to the body 11 but it may be somewhat shorter in an axial direction, as illustrated, since the connections to the contacts are outside, on the rearward side of the receptacle body. It is noted that the rearward body part 99 has surfaces 107 and 108 which are in convergent relation to mate with converging outer surfaces 109 and 110 of the contact 90 disposed between the forward cylindrical portion thereof and the rearward flattened portion 96 thereof.

It is also noted that an opening 111 through which the rearward portion 96 extends is of generally rectangular shape while an opening 112 in the forward body part 100, through which the forward end of contact 90 extends, is of circular shape.

It is further noted that in assembly of the contacts in the body 88, the collar portion 98 serves to limit forward movement of the contact 90, and after insertion of the screw 50, additional support against movement of the contact 90 is provided.

Each of the other contacts 89 and 91-95 has substantially the same construction as the grounding contact 90 except that the forward portions thereof as well as the rearward portions thereof may be somewhat smaller in size, as illustrated. Each of the additional contacts 89 and 91-95 is provided with a collar portion similar to the collar portion 98 which serves as a stop to limit movement of the contact.

After assembly of the contacts between the body parts 99 and 100, the body parts 99 and 100 are secured together by screws 113 and 114. The forward body part 100 may include projecting portions similar to the portions 73 and 74 of part 44 and the rearward body part 99 may include pads similar to the pads 75 and 76 of the body part 43. Such projecting portions and pads may be provided with suitable openings for receiving the shank portions of the screws 113 and 114.

The body parts 99 and 100 are such that they can both be readily formed through a straight-shot molding operation.

It will be understood that other modifications and variations may be effected without departing from the spirit and scope of the novel concepts of this invention.

What is claimed is:

1. In an electrical connector including a hollow housing member having open forward and rearward portions, a body member of insulating material having a forward end portion adapted to be inserted into said rearward open end portion of said housing member to be positioned in an operative relationship with respect thereto, and contact means carried by said body member for engagement with contact means carried by another body member inserted into said forward open end, said rearward end portion of said housing member and said forward end portion of said body member when in said operative relationship having facing internal and external generally cylindrical surfaces, the cylindrical surface of one of said members being formed with a single helical projection having a length of nearly and no more than 360 degrees and the cylindrical surface of the other of said members being formed with a single helical groove having a length of nearly and no more than 360 degrees and being arranged to threadingly receive said projection to hold said members together in said operative relationship when said body member is inserted into said open rearward end of said housing member and rotated approximately 360 degrees to place substantially the full length of said projection within the full length of said groove, said groove being defined by rearwardly and forwardly facing side surfaces in facing relation to each other, and said other of said members being formed by separate forward and rearward parts with said rearwardly facing side surface being formed on said forward part and said forwardly facing side surface being formed on said rearward part.

2. In an electrical connector as defined in claim 1, said helical projection having a generally rectangular cross-sectional configuration and having radially extending and rearwardly and forwardly facing side surfaces, and said helical groove having a generally rectangular cross-sectional configuration and said forwardly and rearwardly facing side surfaces thereof extending radially for sealing engagement with said radially extending rearwardly and forwardly facing side surfaces of said helical projection.

3. In an electrical connector as defined in claim 1, said other of said members having a pair of facing side surfaces defining said groove and an additional side surface cooperating with one of said pair of facing side surfaces to define a helical projection, said additional side surface being initially engaged by said projection of said one of said members to lead said projection of said one of said members into said helical groove of said other of said members.

4. In an electrical connector as defined in claim 1, said housing member and said body member having openings in radial alignment when the full length of said projection is within the full length of said groove, and a locking member extending through said openings to lock said members against relative rotation.

5. In an electrical connector as defined in claim 4, said openings being positioned adjacent the ends of said groove and said projection.

6. In an electrical conductor as defined in claim 4, said housing member being of metal and being adapted for mounting to provide an electrical ground, said contact means carried by said body member including a grounding contact for connection to a ground conductor of a cable connected to said body member, said grounding contact having an opening therein, and said locking member being arranged to extend through said opening in said grounding contact to electrically connect said grounding contact to said housing member.

7. In an electrical connector as defined in claim 1, said helical projection member being provided in said housing member and said helical groove being provided on said body member.

8. In an electrical connector as defined in claim 7, said forward and rearward parts being formed to provide cavities for receiving said contact means, and fastener means for securing said forward and rearward parts together to lock said contact means in position within said body member.

* * * * *